United States Patent [19]

Kenyon et al.

[11] Patent Number: 4,956,112

[45] Date of Patent: Sep. 11, 1990

[54] COMPOSITION FOR SOFTENING FABRICS: CLAY SOFTENING AGENT AND NONIONIC SURFACTANT WITH 0°-15° C. CLOUDY PHASE

[75] Inventors: Ian R. Kenyon, Wirral, England; Bryan C. Smith, Rotterdam, Netherlands

[73] Assignee: Lever Brothers Company, New York, N.Y.

[21] Appl. No.: 179,092

[22] Filed: Apr. 8, 1988

[30] Foreign Application Priority Data

Apr. 15, 1987 [GB] United Kingdom ..... 8709057

[51] Int. Cl.[5] ..... C11D 1/66; C11D 3/12; D06M 11/06

[52] U.S. Cl. ..... 252/8.9; 8/137; 252/8.6; 252/174.13; 252/174.21; 252/174.22; 252/174.25

[58] Field of Search ..... 252/8.6, 174.13, 174.25, 252/8.9, 174.21, 174.22

[56] References Cited

U.S. PATENT DOCUMENTS

| | | | |
|---|---|---|---|
| 3,948,790 | 4/1976 | Speakman | 252/120 |
| 3,966,629 | 6/1976 | Dumbrell | 252/140 |
| 4,062,647 | 12/1977 | Storm et al. | 8/137 |
| 4,166,039 | 8/1979 | Wise | 252/174.14 |
| 4,292,035 | 9/1981 | Battrell | 8/137 |
| 4,375,416 | 3/1983 | Crisp et al. | 252/8.7 |
| 4,582,615 | 4/1986 | Ramachaudran et al. | 252/8.6 |
| 4,605,506 | 8/1986 | Wixon | 252/8.6 |
| 4,609,473 | 9/1986 | Ramachandran et al. | 252/8.6 |
| 4,632,768 | 12/1986 | Atkinson | 252/8.8 |
| 4,680,131 | 7/1987 | Busch et al. | 252/102 |
| 4,746,445 | 5/1988 | Weinstein | 252/8.6 |

FOREIGN PATENT DOCUMENTS

| | | |
|---|---|---|
| 1572815 | 8/1980 | United Kingdom . |
| 2138037 | 10/1984 | United Kingdom . |
| 2163770 | 3/1986 | United Kingdom . |
| 2182051 | 5/1987 | United Kingdom . |
| 2203458 | 10/1988 | United Kingdom . |

*Primary Examiner*—A. Lionel Clingman
*Attorney, Agent, or Firm*—Gerard J. McGowan, Jr.

[57] ABSTRACT

A particulate composition useful in the softening of fabrics from a wash liquor, especially in the form of a fabric washing product, comprises a fabric softening clay and a nonionic surfactant system which has a cloud point below 15° C. The clay/nonionic weight ratio is from 2:3 to 20:1. A typical nonionic surfactant is a fatty alcohol with a low degree of ethoxylation, such as a $C_{13-15}$ alcohol with 3 ethylene oxide groups per molecule.

4 Claims, No Drawings

COMPOSITION FOR SOFTENING FABRICS: CLAY SOFTENING AGENT AND NONIONIC SURFACTANT WITH 0°-15° C. CLOUDY PHASE

BACKGROUND

This invention relates to a composition for softening fabrics and in particular to such a composition which is particulate and capable of imparting a softening benefit to fabric during a wash process.

A number of materials have been suggested in the art for providing softening-in-the-wash benefits. These include certain classes of clay materials, especially smectite clays. Thus GB 1400898 (Procter and Gamble) suggests the use of smectite clays having a relatively high exchange capacity. While some fabric softening benefit can be obtained from detergent compositions containing fabric softening clays, this benefit is generally some way short of that which can be obtained by the application of softening materials to fabrics in the rinse step of a laundering process. Therefore, there is a desire to boost the performance of fabric softening clays in the wash. GB 2138037 (Colgate) proposes that the performance of fabric softening clays can be improved by the removal of grit therefrom and by their addition to the detergent composition as separate agglomerated particles.

Several disclosures in the art suggest that the performance of fabric softening clays is especially poor in the presence of nonionic surfactants. Thus, for example, GB1462484 (Procter & Gamble) proposes that in the presence of nonionic surfactants it is necessary to use smectite clays which have been rendered organophilic by an exchange reaction with quarternary ammonium compounds. GB 1400898, referred to above, is silent on the presence of nonionic surfactants. Also, European Patent Specification EP-11340-A (Procter & Gamble) teaches that, in a composition which includes a mixture of a smectite clay and a tertiary amine for softening-in-the-wash, when anionic surfactants are employed it is preferred that nonionic surfactants be absent, but if mixtures containing nonionics are used, it is preferred that the anionic forms the major part of the mixture.

It is apparent therefore that a prejudice has built up against the use of nonionic surfactants in combination with clays for softening-in-the-wash, especially in the presence of anionic surfactants.

DISCLOSURE OF THE INVENTION

We have surprisingly found however that in the presence of certain nonionic surfactant materials, at a specified level relative to the clay, the fabric softening performance of clays can in fact be enhanced.

The nonionic surfactant or mixture thereof which is essential to the present invention exists as a cloudy phase at 1% concentration in water at a temperature somewhere between 0° C. and 15° C. To obtain the benefits of the invention it is necessary that the weight ratio of the clay to this nonionic surfactant system is from 2:3 to 20:1, preferably from 1:1 to 10:1. Any other nonionic surfactant material present which does not exist as a cloudy phase between these specified temperatures is not counted for the purposes of calculating the required clay to nonionic ratio.

The compositions of the invention may be in any particulate form, especially where the clay and the nonionic surfactant system are not in undiluted intimate contact with each other. More specifically however, this composition may be in the form of clay agglomerates which are formed of fine particle size clay, bound together with a material other than said nonionic surfactant system as a binder, or with no binder at all, the agglomerates carrying the nonionic surfactant system on the surface thereof. Alternatively, it is possible for the compositions of the invention to be in the form of spray-dried granules, formed, for example, by preparing an aqueous slurry containing the clay and the nonionic surfactant system and spray-drying the slurry to form the granules. A further alternative is to spray the nonionic surfactant system onto spray-dried base powder granules which may contain the clay or may have previously been mixed with the clay. Still further, the nonionic surfactant system may be carried on a suitable carrier material, the clay being separately added to the composition.

All the above forms of the composition may contain other ingredients, especially ingredients useful in the washing of fabrics. Alternatively, such other ingredients may be added separately. In either case a fully formulated fabric washing product may be obtained, and it is preferred that overall such products contain at least from 2% to 50%, most preferably from 5% to 40% by weight of a detergent active material, which amount includes the nonionic surfactant system associated with the fabric softening clay; from 20% to 70%, most preferably from 25% to 50% by weight, of a detergency builder material and from 1.5% to 35%, most preferably from 4% to 15% by weight of fabric softening clay material having associated with it the nonionic surfactant system.

THE NONIONIC SURFACTANT SYSTEM

The nonionic surfactant system of the present invention exists as a cloudy phase somewhere in the temperature range of 0° C. to 15° C., preferably 0° C. to 10° C. in distilled water at 1% concentration. In practise this means that the system has a cloud point of not more than 15° C., preferably not more than 10° C. Cloud point is a term well known in the art, for example from Surface Active Ethylene Oxide Adducts by N. Schonfeldt, Pergamon Press 1969, pp 145 to 154. In general terms the cloud point of a surfactant material is the temperature at which association between the surfactant and water molecules through hydrogen bonding breaks down, leading to the separation of surfactant rich and water rich phases and a consequential increase in turbidity or cloudiness.

The cloud point correlates approximately to the hydrophilic-lipophilic balance (HLB) of the surfactant system and it is therefore preferred that the HLB should be less than 9.5, such as not more than 9.2. The HLB should preferably be above 6.0, most preferably above 8.0 to provide sufficient detergency.

Suitable nonionic detergent compounds which may be used include in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, the condensation products of aliphatic ($C_8$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

Where, for example, alkylene oxide adducts of fatty materials are used as the nonionic detergent compounds, the number of alkylene oxide groups per molecule has a considerable effect upon the cloud point as indicated by the Schonfeldt reference mentioned above. The chain length and nature of the fatty material is also influential, and thus the preferred number of alkylene oxide groups per molecule depends upon the nature and chain length of the fatty material. We have found for example that where the fatty material is a fatty alcohol having about 13 to 15 carbon atoms, the adduct having 3 ethylene oxide groups per molecule has a cloud point of less than 0° C. and is therefore suitable for use in the present invention. A similar surfactant having 7 ethylene oxide groups per molecule has a cloud point of about 48° C. and is therefore unsuitable. Further ethoxylation raises the cloud point still higher. Thus the similar surfactant with 11 ethylene oxide groups per molecule has a cloud point higher than 80° C.

Where mixtures of surfactant materials are used, it is the properties of the individual components of the mixture rather than their average properties which are important.

Thus, whilst a 1:1 mixture of such 3EO and 11EO ethoxylated alcohols may well have an HLB close to that of the 7EO material, the 7EO material alone would give a clear solution below 15° C., passing to a cloudy condition above about 48° C., while the mixture would be cloudy below 15° C. In the context of the present invention therefore, the use of the 7EO material would be unsuitable while the mixture of 3EO and 11EO materials would be suitable. However, when a mixture of nonionic surfactants is present for the purposes of determining the suitable clay to nonionic ratio only those nonionic materials which exist in the cloudy phase are counted. With some mixtures of nonionic surfactants, especially mixtures of surfactants which do not have closely related structures, some separation may occur so that some components of the mixture form the cloudy phase while others, generally the more soluble components, exist only in the clear phase. Analysis of the cloudy phase, using methods well known in the art, can determine the content of the cloudy phase in these circumstances.

THE CLAY MATERIAL

The clay containing material may be any such material capable of providing a fabric softening benefit. Usually these materials will be of natural origin containing a three-layer swellable smectite clay which is ideally of the calcium and/or sodium montmorillonite type. It is preferable to exchange the natural calcium clays to the sodium form by using sodium carbonate, as described in GB 2 138 037 (Colgate). The effectiveness of a clay containing material as a fabric softener will depend inter alia on the level of smectite clay. Impurities such as calcite, feldspar and silica will often be present. Relatively impure clays can be used provided that such impurities are tolerable in the composition. In calculating the suitable clay to nonionic ratios however, it is the amount of smectite clay present which is important.

OPTIONAL COMPONENTS

When the compositions of the invention, or the fabric washing products containing them, contain a detergent active material in addition to the nonionic surfactant system referred to above, this may be selected from other nonionic detergent active materials, anionic detergent active materials, zwitterionic or amphoteric detergent active materials or mixtures thereof.

The anionic detergent active materials are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to produce a random sulphonate; and olefin sulphonates, which term is used to describe the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

When the compositions of the invention, or the fabric washing products containing them, contain a detergency builder material this may be any material capable of reducing the level of free calcium ions in the wash liquor and will preferably provide the composition with other beneficial properties such as the generation of an alkaline pH, the suspension of soil removed from the fabric and the dispersion of the fabric softening clay material.

Examples of phosphorus-containing inorganic detergency builders, when present, include the water-soluble salts, especially alkaline metal pyrophosphates, orthophosphates, polyphosphates and phosphonates. Specific examples of inorganic phosphate builders include sodium and potassium tripolyphosphates, phosphates and hexametaphosphates.

Examples of non-phosphorus-containing inorganic detergency builders, when present, include water-soluble alkali metal carbonates, bicarbonates, silicates and crystalline and amorphous alumino silicates. Specific examples include sodium carbonate (with or without calcite seeds), potassium carbonate, sodium and potassium bicarbonates and silicates.

Examples of organic detergency builders, when present, include the alkaline metal, ammonium and substituted ammonium polyacetates, carboxylates, polycarboxylates, polyacetyl carboxylates and polyhydroxsulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid.

Apart from the ingredients already mentioned, a number of optional ingredients may also be present, either as part of the clay containing compositions or as part of the overall fabric washing product.

Examples of other ingredients which may be present in the composition include the lather boosters, lather depressants, oxygen-releasing bleaching agents such as sodium perborate and sodium percarbonate, peracid bleach precursors, chlorine-releasing bleaching agents such as tricloroisocyanuric acid, inorganic salts such as sodium sulphate, and, usually present in very minor amounts, fluorescent agents, perfumes, enzymes such as proteases and amylases, germicides and colourants.

EXAMPLES

The invention will now be illustrated by the following non-limiting examples.

EXAMPLES 1 and 2

Detergent compositions were prepared by spray-drying some ingredients to form a spray-dried base powder and then post-dosing the remaining ingredients. The approximate formulations were as follows:

| Ingredients (% by weight) | Example No: 1 | 2* |
|---|---|---|
| Spray-dried: | | |
| Anionic detergent active | 9.0 | 9.0 |
| Nonionic Active A7[1] | 1.0 | 1.0 |
| Sodium tripolyphosphate | 21.5 | 21.5 |
| Sodium alkaline silicate | 5.5 | 5.5 |
| Polymer[2] | 2.7 | 2.7 |
| Water and minor ingredients | 10.3 | 10.3 |
| Post-dosed | | |
| Sodium perborate monohydrate | 5.0 | 5.0 |
| Silicone antifoam granule | 1.2 | 1.2 |
| TAED | 4.6 | 4.6 |
| Dequest | 0.2 | 0.2 |
| Sodium carbonate | 5.0 | 5.0 |
| Burkeite/A3[3] | 12.0 | — |
| Burkeite/A7[4] | — | 12.0 |
| Clay[5] | 10.0 | 10.0 |
| Sodium sulphate | balance | balance |
| *comparative example | | |

NOTES

[1]Synperonic A7 (ex ICI) which is a $C_{13}$-$C_{15}$ alcohol ethoxylated with approximately 7 moles of ethylene oxide per molecule and having a cloud point 48° C.

[2]DKW 125N (ex National Starch) which is a phosphinated polyacrylate anti-redeposition polymer.

[3]Synperonic A3 (as A7 but containing an average of three moles ethylene oxide per molecule) 1 part carried on 3 parts Burkeite. Synperonic A3 has a cloud point of less than 0° C.

[4]As 3, but using A7 in place of A3.

[5]ASB1.7 (ex English China Clay) in the form of granulated calcium montmorillonite from Morocco (94% montmorillonite).

It will be seen that the nonionic surfactant system in Example 1 consists of 1% A7 plus 3% A3 while the nonionic surfactant system in comparative Example 2 consists of 4% A7.

In order to compare the softening-in-the-wash performance of these two formulations, they were used to wash fabrics under the following conditions:

| | |
|---|---|
| Dosage | 6 g/l |
| Water hardness | 24° FH |
| Wash temperature | 40° C. or 60° C. |
| Fabrics | Preharshened terry towelling |
| Wash time | 30 minutes |
| Rinse | 3 × 5 minutes |

After line drying, the treated fabrics were judged for softness by a panel of experienced assessors who together assign a softening score for each tested formulation.

The results were as follows, with softening being expressed as a percentage of the maximum possible preferance score:

| Example No. | Softness at 40° C. | Softness Score 60° C. |
|---|---|---|
| 1 | 69% | 82% |
| 2 | 31% | 16% |

A 20% difference in softness is significant. These results demonstrate the softening benefit obtained in the case of the composition according to the invention is preferred, at both 40° C. and 60° C., to that obtained with a similar composition not containing the low cloud point nonionic surfactant system.

EXAMPLES 3 and 4

Detergent compositions were prepared by post-dosing the following ingredients to the same base powder as used in Example 1:

| Example No: | 3 | 4* |
|---|---|---|
| Ingredients (parts by weight) | | |
| Base powder | 50.0 | 50.0 |
| Sodium carbonate | 5.0 | 5.0 |
| Burkeite/A3 | 12.0 | — |
| Burkeite/A7 | — | 12.0 |
| Clay | 20.0 | 20.0 |

*comparative example

These formulations were evaluated in the same manner as described in Examples 1 and 2 with the following results:

| Example No. | Softness at 40° C. |
|---|---|
| 3 | 81% |
| 4 | 14% |

A significant benefit is shown for the use of a nonionic surfactant system with the lower cloud point.

Similar results are obtained when the granulated calcium montmorillonite is replaced with the sodium equivalent or with Detecol, which is an impure calcium montmorillonite clay (40% montmorillonite) in granular form (ex Carlo Laviosa, Italy).

EXAMPLES 5 to 13

Compositions were prepared by spray-drying the following ingredients, the nature of which was the same as in Examples 1 and 2.

| Ingredients (parts by weight) | |
|---|---|
| Anionic detergent active | 9.0 |
| Nonionic active A7 | 1.0 |
| Sodium tripolyphosphate | 21.5 |
| Sodium alkaline silicate | 5.5 |

-continued

| Ingredients (parts by weight) | |
|---|---|
| Polymer | 2.7 |
| Water | 10.3 |

To this spray-dried base was added 10 parts of Prassa clay (ex Colin Stewart Minerals—96% montmorillonite) and a variable amount of nonionic active A3, as set out below.

In order to compare the softening-in-the-wash performance of these formulations, they were used to wash fabrics under the following conditions:

| | |
|---|---|
| Dosage | Equivalent to 0.5 g/l clay |
| Water hardness | 24° FH |
| Wash temperature | 40° C. |
| Fabrics | Preharshened terry towelling |
| Wash time | 15 minutes |
| Rinse | 2 × 2 minutes |

Softness assessment was carried out as described in connection with Example 1, each composition being compared with that of Example 5, which contained no A3.

The results were as follows:

| Example No | % A3 | % Preference against control |
|---|---|---|
| 5* | — | Control |
| 6* | 0.4 | 44% |
| 7 | 0.67 | 58% |
| 8 | 1.0 | 67% |
| 9 | 3.0 | 71% |
| 10 | 5.0 | 71% |
| 11 | 10.0 | 71% |
| 12 | 15.0 | 67% |
| 13* | 20.0 | 49% |

In all of these examples (except Example 5) A3 will exist as a cloudy phase below 15° C. These results show that softening performance initially improves as the level of low cloud point nonionic active is increased, reaching an optimum level with about 3% A3. Thereafter, the addition of further A3 produces no improvement, leading eventually to a loss of performance.

We claim:

1. A particulate composition for softening fabrics from a wash liquor, said composition comprising a fabric softening clay material which is a three-layer swellable smectite clay of the montmorillonite type and a nonionic surfactant system which has a cloudy phase, at 1% concentration in water somewhere, within the temperature range of 0° C. to 15° C., the weight ratio of said clay material to said nonionic surfactant system being from about 2:3 to about 20:1 in which said nonionic surfactant system has an HLB of less than about 9.5.

2. A composition according to claim 1, in the form of agglomerated particles of said fabric softening clay, carrying said nonionic surfactant system on the surface thereof.

3. A composition according to claim 1, in the form of spray-dried granules containing said fabric softening clay and said nonionic surfactant system.

4. A particulate fabric washing product for softening fabrics from a wash liquor, said product comprising:

(i) from 2% to 50% by weight of a detergent active system selected from a nonionic surfactant system and mixtures thereof with other detergent active materials, the nonionic surfactant system having a cloudy phase, at a 1% concentration in water somewhere, within the range of 0° C. to 15° C. in which said nonionic surfactant system has an HLB of less than about 9.5;

(ii) from 20% to 70% by weight of a detergency builder; and (iii) from 1.5% to 35% by weight of a fabric softening clay material which is a three-layer swellable smectite clay of montmorillonite type, the weight ratio of the clay to the nonionic surfactant system being from about 2:3 and about 20:1.

* * * * *